US009534374B1

(12) United States Patent
Mogck et al.

(10) Patent No.: US 9,534,374 B1
(45) Date of Patent: Jan. 3, 2017

(54) ATTIC FLOORING AND STORAGE SYSTEM

(71) Applicants: Jon Mogck, Rosemount, MN (US); Leo Moretto, Burnsville, MN (US); Keith Lockwood, Minneapolis, MN (US)

(72) Inventors: Jon Mogck, Rosemount, MN (US); Leo Moretto, Burnsville, MN (US); Keith Lockwood, Minneapolis, MN (US)

( * ) Notice: Subject to any disclaimer, the term of this patent is extended or adjusted under 35 U.S.C. 154(b) by 0 days.

(21) Appl. No.: 14/873,697

(22) Filed: Oct. 2, 2015

(51) Int. Cl.
*E04B 1/41* (2006.01)
*E04B 5/02* (2006.01)
*E04B 1/38* (2006.01)

(52) U.S. Cl.
CPC . *E04B 1/40* (2013.01); *E04B 5/02* (2013.01); *E04B 2001/405* (2013.01)

(58) Field of Classification Search
CPC ..... E04B 1/40; E04B 5/02; E04B 2001/405
See application file for complete search history.

(56) References Cited

U.S. PATENT DOCUMENTS

D25,034 S * 12/1895 Hunter ..... 52/846
2,630,890 A * 3/1953 Macomber ..... E04C 3/09 52/377
3,221,467 A * 12/1965 Henkels ..... E04C 3/09 52/690
3,755,979 A * 9/1973 Pantazi ..... E04B 2/825 52/241
4,879,856 A * 11/1989 Jones ..... E04F 15/20 52/403.1
4,937,998 A * 7/1990 Goldberg ..... E04B 2/7409 52/690
5,058,352 A * 10/1991 Loiselle ..... E04B 1/7654 52/404.2
5,544,459 A * 8/1996 Konger ..... E04B 5/12 52/220.3
D417,290 S * 11/1999 Goleby ..... D25/122
6,397,550 B1 * 6/2002 Walker ..... E04C 3/07 52/481.1
6,591,576 B1 * 7/2003 Iida ..... B21D 47/01 52/843
D672,063 S * 12/2012 Geven ..... F16B 5/0216 D25/122
2005/0258722 A1 * 11/2005 Sullivan ..... E04B 5/12 312/245
2007/0028550 A1 * 2/2007 Clapper ..... E04G 3/26 52/650.3

(Continued)

OTHER PUBLICATIONS 2 page excerpt from Home Depot website (www.homedepot.com) of Attic Dek Flooring Panels printed out on Oct. 2, 2015.

(Continued)

*Primary Examiner* — Joshua J Michener
*Assistant Examiner* — Omar Hijaz
(74) *Attorney, Agent, or Firm* — Advantage IP Law Firm

(57) ABSTRACT

An attic flooring and storage system for laying out a support floor in an attic or other framed structure, the system comprising a number of support brackets with a mounting saddle including at least one mounting guide for removably suspending the brackets over a joist type member while disposing the upper surface of at least one laterally projecting support wing to support and align a flooring panel with at least one angular brace constructed to transfer bending forces about a joint between the support wing and the adjacent mounting guide to the joist.

15 Claims, 8 Drawing Sheets

(56) References Cited

U.S. PATENT DOCUMENTS

2009/0090279 A1* 4/2009 Wainland ..... F16B 5/0216
108/42

OTHER PUBLICATIONS 2 page excerpt from Home Depot website (www.homedepot.com) of Infinite Attic Saddle Storage System printed out on Oct. 2, 2015.

* cited by examiner

ATTIC FLOORING AND STORAGE SYSTEM

BACKGROUND OF THE INVENTION

1. Field of the Invention

The present invention relates generally to a flooring system for use in attics and the like, which have ceiling joists and attic trusses. More specifically, it relates to a storage system that may be quickly, effectively installed using the floor joists.

2. Background Art

Additional storage place in homes is in great demand worldwide. This is particularly evident with the substantial increase in home based businesses. The most used storage location in a home is the garage. Many, if not most, homes are built with a garage with unfinished attic space. This attic space typically is constructed of joists spaced 16" or 24" apart, measured on center. The angular truss system above the joists creates a rather substantial open space that goes unused, or that may be converted into a storage space.

Home owners who wish to use this unfinished attic space for storage typically use boards or sheets of plywood, cut or whole, which have been pushed up between the joists and then placed atop the ceiling joists in a more or less haphazard manner. Larger sheets of plywood are frequently difficult to push up inside the attic space due to interference with the network of trusses. Thus, smaller sheets, narrower sheets, and boards are used to create a floor space above the spaced joists.

Using the various pieces of assorted wood for a floor usually results in a hodge-podge of floors, some narrow, some wide, and almost always leaves large gaps and unused spaces. In such a configuration placing boxes upon the temporary flooring becomes a challenge whereas some cartons may rest atop two or more spaced boards or may be precariously balanced atop one. At times when a full sheet of plywood is used, boxes are liberally stored atop it, one behind the other, with no access to the rearward boxes. In addition, these makeshift floors are unattractive and unsafe. The removal of cartons, or accidental striking, can result from a fall from the attic.

Another approach to creating storage space in a garage attic is to employ a skilled carpenter to build a secure flooring network atop the joists. This option is therefore permanent and requires a well thought out scheme ahead of time in order to ensure adequate use of flooring space, and for desired accessibility to users. Once in place this flooring may not be adjusted to accommodate various box and article sizes.

Having a permanent storage flooring installed professionally would typical cost between $1,800-3,500.00 for an average 2 car size garage of 360 sq. ft. This cost includes the materials and labor to (some garage attics having already been enclosed with a sheet rocked ceiling are very difficult to install a permanent flooring system), measure and make cuts to the Plywood sheets to be used as flooring in order to fit around trusses, electrical wiring or any other protruding obstacles. It also includes the labor to secure the flooring to the joists using screws or nails. To properly cut around trusses requires substantial planning and skill and use of power tools. Once the flooring is cut and secured to the joists by nails or screws it is permanent and may not be modified or adjusted without substantial effort and additional cost.

One potential solution is the Attic Dek attic flooring plastic panel system available from Home Depot. According to the Home Depot website, the Attic Dek attic flooring panel system provides the user with additional attic storage space. The Attic Dek system is sold in 10 packs of 16 in.×16 in. plastic flooring panels that purport to support up to 250 lb. and are vented so insulation can breathe easily. The panels are installed by laying them on top of ceiling joists and securing them with the included screws. However, the user must verify their joist spacing to avoid ordering wrong size and the 10 pack covers only 26⅔ sq. ft. In addition, this system is relatively expensive, requires some basic carpentry skills, does not work around trusses since the panels are pre-formed and pre-sized and lay directly atop the joists, and is not eco-friendly.

Another solution is the Infinite Attic saddle storage system, also available from Home Depot. The saddle storage system is provided in 30-78 Pack assortments that provide approximately 32 sq. ft.-192 sq ft. of brackets for supporting sheets of plywood for storage space in the attic. The saddles are designed to be used with one or more sheets of plywood and must use additional 2×2×8 lumber. The metal bracket has an elongated rectangular central section with a raised flat topped peak that rests atop a joist between two laterally opposed upwardly facing channels with outermost perpendicularly projecting upwardly narrow supports and is roughly similar to a square waveform with an enlarged inverted middle section and two spaced apart shorter channels to support 2×2×8 lumber which a sheet of plywood would lay over. These saddles utilize the available space between the attic trusses for a continuous, platform between trusses. While there are some advantages to such a system, the Infinite Attic saddle storage system requires multiple purchases, is difficult to work around electrical wires and fixtures as well as roof trusses. It requires extra measuring and cutting of the 2×2×8 lumber, some basic carpentry skills, and does not work with most insulation because the system including the 2×2×8 lumber impedes or hangs well over half the joist height, creating an obstacle for the insulation and existing wiring or plumbing. In addition this solution still requires screwing of the 2×2 lumber base and makes the additional cost and purpose of the Infinite Bracket counter intuitive.

Reviewing the foregoing solutions, such a seemingly simple task of creating flooring for storage in its unused attic space is expensive, requires extensive carpentry skills or a contractor, is inefficient with respect to installation and space utilization, creates accessibility issues and creates additional problems when encountering existing trusses, insulation, wiring or plumbing. An attic flooring and storage system that overcomes the numerous problems associated with these prior art systems and methods would be valuable to the home trade and many others.

SUMMARY OF THE INVENTION

The attic flooring and storage system of the present invention overcomes the problems associated with prior art. The present invention is a low cost alternative that may be installed by unskilled home owners and laborers. Likewise it provides a sturdy, flat surface with the potential to maximize the use of the attic space. It may also be changed, modified, or adjusted as desired.

The present invention uses our unique brackets to simply be positioned and fit over the attic joists, or rafters, whereby 4×8 sheets of OSB (oriented strand board) or plywood (cut perpendicular to the direction the joist is hung) can be used as flooring. Joists are generally hung 16" or 24" on center and therefore 4×8 sheets are to be measured and cut to fit between the joists accordingly. The floor panel then may be inserted into the attic space and thus rest atop the brackets to create a seamless floor. There is no need for cutting and manipulating around the trusses because the floor board lies flush with the top of the joist in between the joists.

The present invention consists of one component: a moveable structural bracket that supports substantial weight and holds a flooring panel in place to securely rest atop the structural brackets. Included in the invention is a template which allows the user to easily mark and drill 4 holes on the ends of each 2×4 plank (OSB or Plywood). These holes are used align the tab on the invention into the hole which "snaps" the board in place and holds securely on top of the Fast Floor Brackets. This is done by the user in a matter of minutes. While basic instructions for installation may be provided, the installation and use of the flooring system of the present invention is intuitive to most users.

The attic flooring and storage system of the present invention is properly installed without tools and without error. Once installed, users may quickly adjust the flooring space by sliding or moving the brackets along the joist and readjusting the OSB or Plywood panels to again rest securely, with its holes aligned atop the tab on the brackets. An unskilled user may create a longer storage flooring space in a matter of minutes. Likewise a user may disassemble the entire flooring system—brackets and panels—in just a few minutes, and reinstall it in a new location, for example a new home or rented residence.

At least one embodiment of the present invention is typically accounting for joists spaced at 16" and 24" centers to accommodate the large majority of standardized garage construction. However, any spacing may be fabricated to accommodate standards in countries incorporating the metric system. The unique structural support bracket is designed to mount atop standard non-dimensional wood, either 2×4's or 2×6's, in other words it mounts atop a rafter or joist that is approximately 1.5" wide. Once in place the bracket is movable along the length of the rafter, either by sliding or pick up and replacement at a new location, or may be removed for use at a later time.

The present invention may be used in any number of applications in addition to a garage, as, for example, any unfinished attic system in a warehouse, barn, or other buildings. It may also be used in the attic space in the home (as opposed to the garage) in order to quickly create a suitable storage substrate atop the ceiling joists and atop the otherwise vulnerable, weak ceiling material, such as sheetrock or certain types of hanging ceilings.

The objectives of the present invention are to provide:

1) An attic storage system;

2) Creating a storage floor utilizing existing joists and rafters;

3) A storage substrate for attics;

4) An adjustable storage system;

5) An adjustable planar substrate;

6) A portable storage system for attics;

7) An adjustable support bracket for floor panels;

8) A movable support bracket for floor panels;

9) Flooring panels for attics;

10) Flooring panels for mounting atop support brackets;

11) Instructions and template to drill holes on each floor panel to align atop support brackets;

12) Flooring panels mounted atop support brackets used for storage;

13) A means of installing a storage system atop joists;

14) A means of using and storing items above joists;

15) A means of adjusting and moving a storage system, and;

16) A method of utilizing and securing the flooring panels to the brackets.

Furthermore it is an object of this application to illustrate the preferred embodiments and methods, and broadly state the scope of the present invention and its methods of uses.

All of the embodiments summarized above are intended to be within the scope of the invention herein disclosed. However, despite the discussion of certain embodiments herein, only the appended claims (and not the present summary) are intended to define the invention. The summarized embodiments, and other embodiments and aspects of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENTS

A. Description of the Present Invention

Figure 1A:
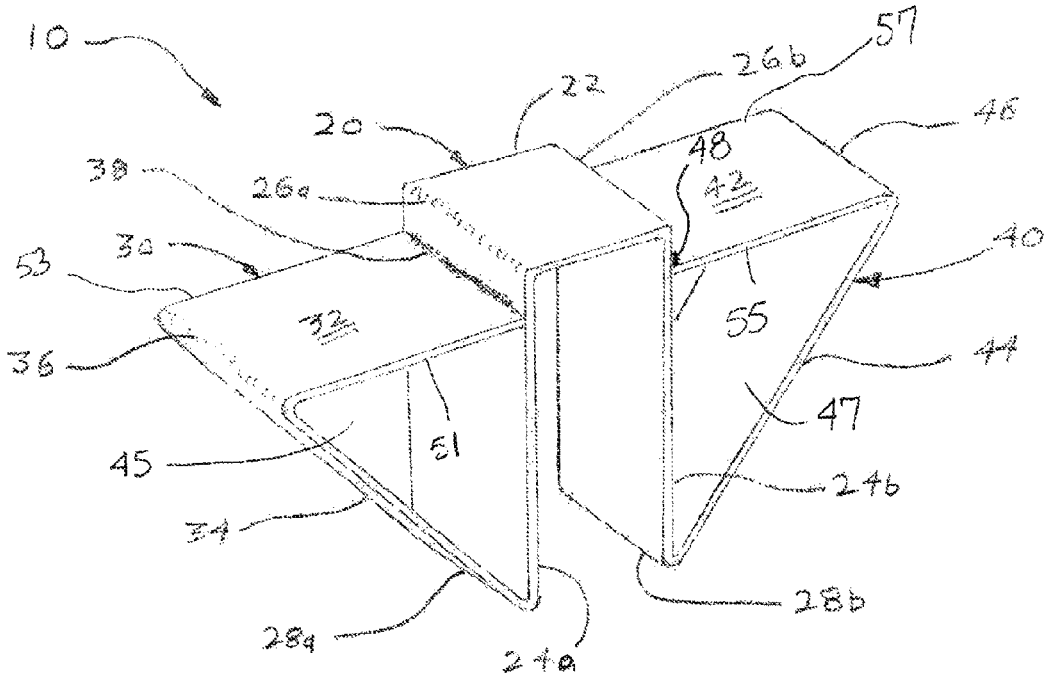
FIG. 1*a* is a perspective view of a support bracket in accordance with the principles of the present invention.
Figure 4A:
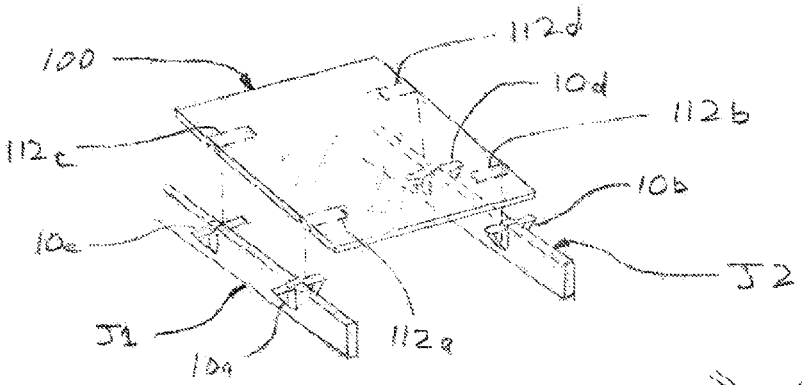
FIG. 4*a* is a perspective view of an exemplary floor panel of the present invention positioned above joists having support brackets in place.
Figure 4B:
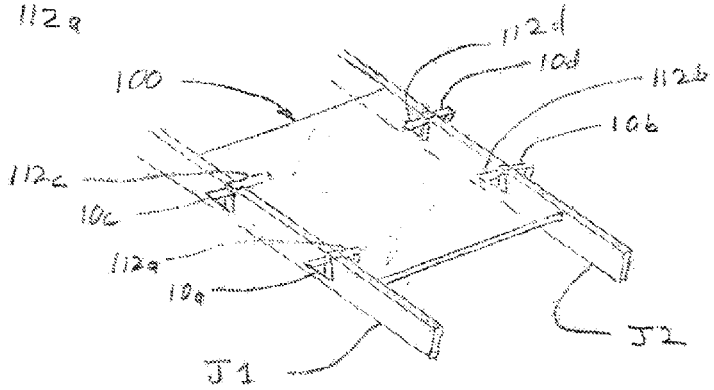
FIG. 4*b* is a perspective view of the floor panel in FIG. 4*a* placed atop the support brackets in FIG. 4*a*.
Figure 4C:
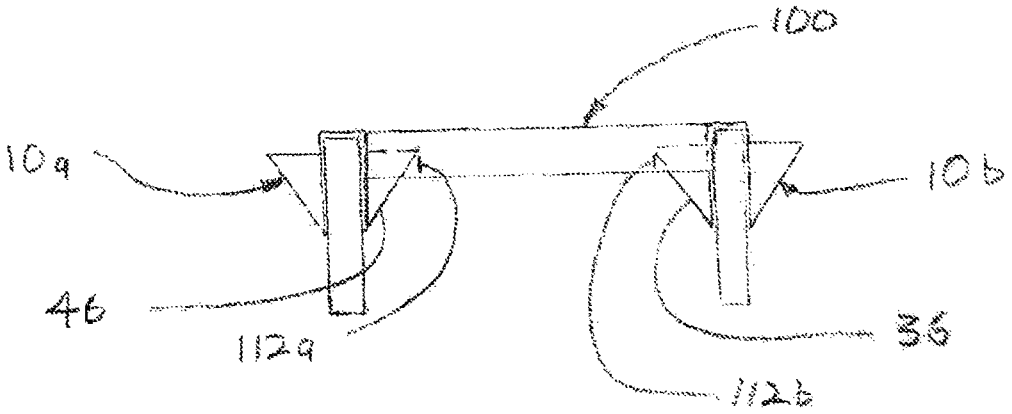
FIG. 4*c* is an end view of the floor panel of the present invention placed securely atop two brackets of the present invention.

In FIG. 1*a* support bracket 10 may be made from one continuous piece of metal in a series of bends with a centrally located upside down "U" member 20, a left side support member 30, and a right side support member 40. Upside down "U" member 20 consists of a top plate 22 and two perpendicular right members or guides 24*a* and 24*b*, which are connected to the top plate 22 at bends 26*a* and 26*b*. Left and right side support members 30 and 40 consist of top members or wings 32 and 42 respectively, and angular support members or braces 34 and 44 respectively. The two top members 32 and 42 are connected to angular support members 34 and 44 at bends 36 and 46 respectively. As illustrated the braces 34, 44 of the respective angular support members 30 and 40 are connected to uprights 24*a*, 24*b* respectively, at bends 28*a* and 28*b* and the wings 32, 42 are connected to the uprights 24*a*, 24*b* at welds 38 and 48, respectively. This forms a hollow space 45, 47 between each respective guide, wing, and brace set (24*a*, 32, 34 and 24*b*, 42, 44). In this exemplary embodiment, the upper surface of each wing 32, 42, projects outwardly from its respective guide 24*a*, 24*b* at an intermediate point along a length of each guide and includes welds 38 and 48 to create a joint therebetween. By locating the upper surface of each wing below the upper surface of the top plate 22, the broad wing upper surfaces may accept and support the floor panels from the joists they are suspended therefrom and provide a flat continuous surface over the top surface of each panel and the intermediate top surface of the top plate 22 as illustrated in FIGS. 4*a*, 4*b*, and 4*c*. This continuous surface features assists in removing a tripping hazard due to uneven surfaces.

Figure 1B:
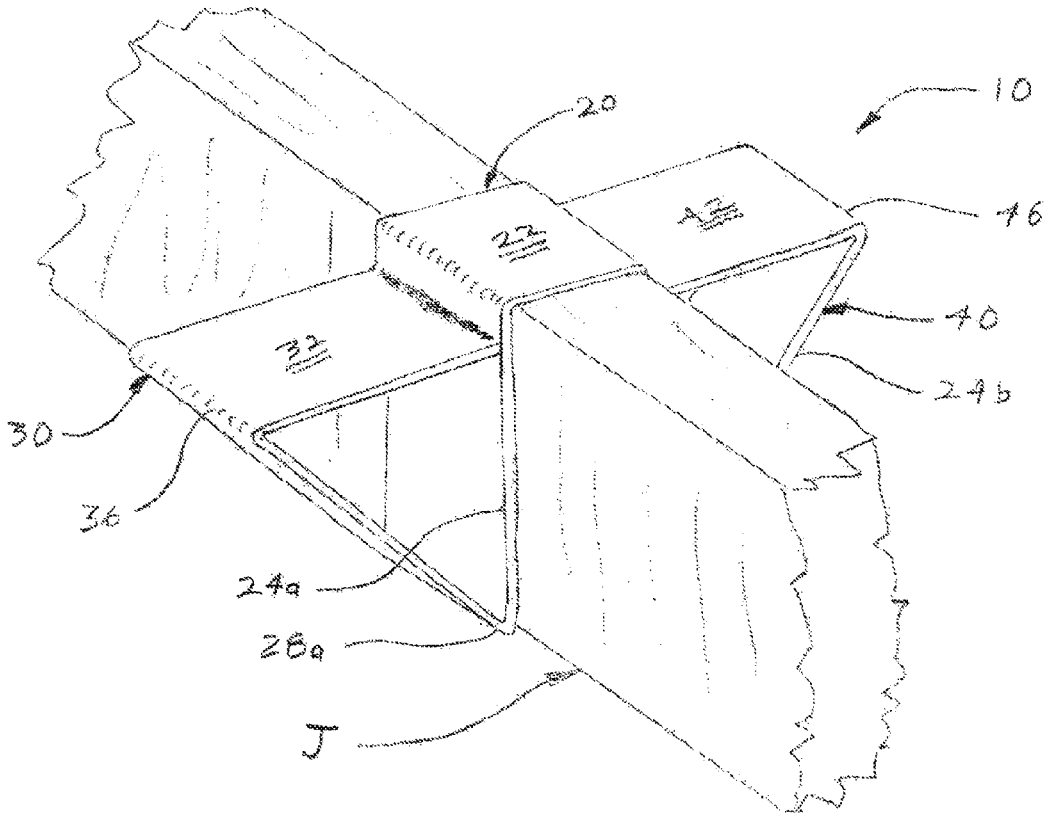
FIG. 1*b* is a perspective view of the support bracket of FIG. 1*a* of the present invention mounted atop a joist.

In FIG. 1*b* the support bracket 10 of FIG. 1*a* is mounted atop joist J with the upside down "U" member 20 serving as a saddle with a top plate 22 resting flush atop joist J and side support members 30 and 40 snugly secured against the two sides of the joist J. The guides may be spaced apart to ease a sliding adjustment along the top surface of the joist or more closely spaced to abut and squeeze the sides of the joist to more securely fix the brackets in place along a length of the joist, although they remain removable. The typical dimensions of the support bracket 10 would be that which fits snug upon attic or ceiling joists. For example, the distance between upright members 24*a* and 24*b* would be about 1.5" in order to fit snug around a standard 2×4 joist which measures 1.5" think by 3.5" high. The length of upright supports 24*a* and 24*b* would typically be about 3.5" to match the height of a 2×4. The outward length of top members 32 and 42 would typically be equal to the height of uprights 24*a* and 24*b*, in other words about 3.5". This configuration creates equal 45 degree angles at bends 36, 46, 28*a*, and 38*b* (not shown).

These angles may be less or more but ideally an angle of about 45 degrees or less on bends 28*a* and 28*b* provide maximum structural capacity for loads to be placed upon the flooring, while providing sufficient surface for the flooring panels to rest upon. The braces 34, 44 generally project at an acute angle to their adjacent wings 32, 42 toward their adjacent guides 24*a*, 24*b* to intersect the guides at bends 28*a*, 28*b*. In addition, the angled supports 34, 44 transfer forces placed upon the top wing members 32, 42 about the corresponding welded joints 38, 48 respectively back into the side of the joist J. This provides additional structural support to the bracket 10 versus a square waveform bracket such as the Infinite Attic support brackets which only have a single stress point at the lower edge leading to a higher likelihood of breakage and injury from a collapsing panel and especially from a weight bearing collapsing panel. The typical width of support bracket 10 is about 1.25" but this may be increased or decreased as the case may be. Based on the revealed invention and the dimensions illustrated, floor panels mounted atop the support brackets can withstand a load of about 250 lbs per sq. ft.

The dimensions of the present invention may vary widely depending upon needs, countries, and the material used. For example, a support bracket may be 5.5" tall to accommodate 2×6 joists, or a user may use one standard version at 3.5" tall for all floor joists of 2×4, 2×6, 2×8, 2×10, and so on. Widths may vary and might be substantially wider for industrial applications. The support bracket material may be any number of types of steel, typically of a width of 0.003125 or thicker, but may also be thinner. The present invention may also be constructed of other metals, wood, or a heavy duty plastic. Other suitable materials will occur to one or ordinary skill in the art. The support brackets of the present invention may also include a series of holes such that a user may permanently affix a bracket to a joist or to a panel.

Figure 2:
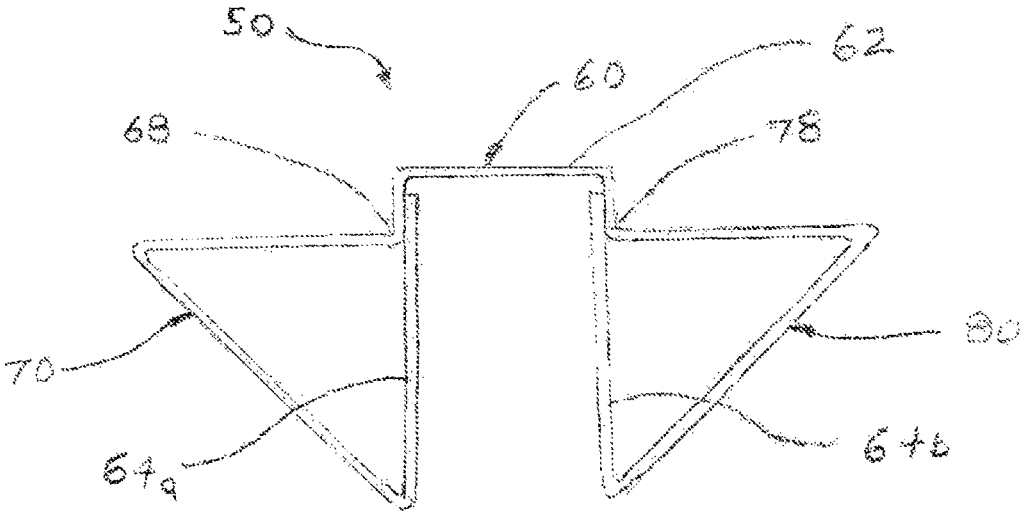
FIG. 2 is a front view of a variation of the support bracket of the present invention.

In FIG. 2 support bracket 50 is similar in construction to that of bracket 10 with an upside down "U" shaped member 60, and two side support members, 70 and 80. While both are manufactured from a single piece of bent steel, support bracket 50 has bends 68 and 78 instead of welds such as 38 and 48 of FIG. 1*a*. In this configuration, uprights 64*a* and 64*b* extend upward towards top plate 62 to complete the side support members 70 and 80. In either bracket 10 or 50, the structural capacity to withstand loads is about the same. The only difference of import is the lower cost of replacing two welds (38 and 48 of FIG. 1*a*) with bends 68 and 78.

Figure 3:
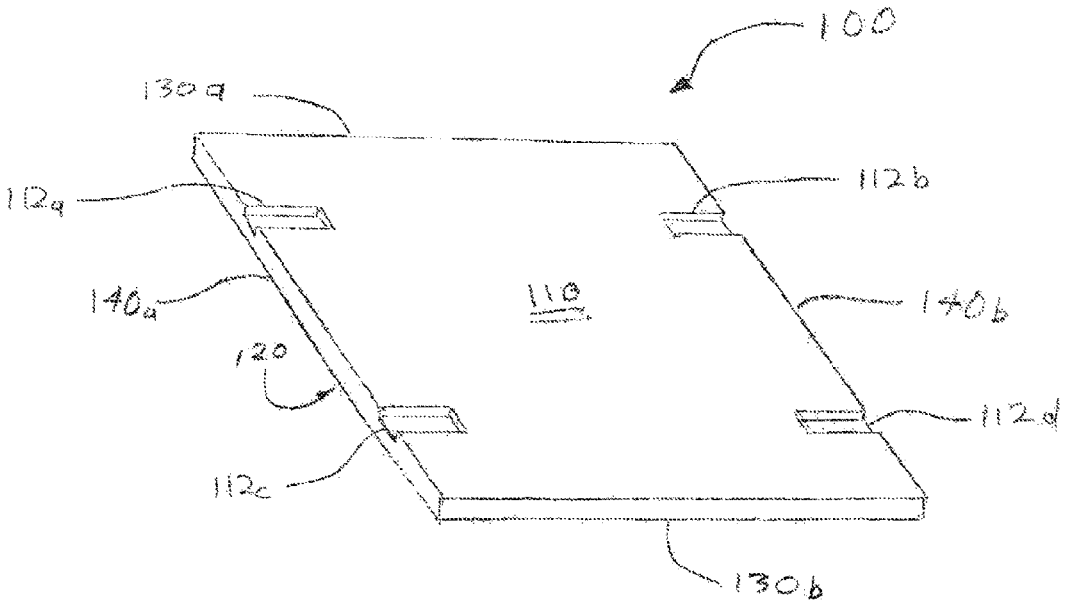
FIG. 3 is a perspective view of the bottom side of an exemplary floor panel for use with one or more support brackets in accordance with principles of the present invention.

In FIG. 3 floor panel 100 of the present invention is illustrated in an inverted disposition for clarity and consists of a bottom surface 110, a top surface 120, two ends 130*a* and 130*b*, and 2 sides 140*a* and 140*b*. Panel 100 is typically constructed of wood, particle board, MDF, laminate, composites, or rigid plastics about ¾" thick, but other suitable materials and thicknesses may be used. Bottom surface 110 consists of four notches 112*a*, 112*b*, 112*c*, and 112*d*. These notches correspond in size to the top members 32 and 42 of bracket 10 in FIG. 1*a*. The forward edge 51, 55 and rearward or trailing edge 53, 57 of each wing 32, 34, respectively (FIG. 1*a*) provide an alignment feature for assisting the user in inserted the wings into the notches or recesses of the panels. It will be appreciated that a suitable alignment alternatives include at least a panel with a downwardly projecting peg for insertion into a recess, notch, or aperture in a corresponding bracket wing, a bracket wing with a boss, tab, or fin for engaging a complementary recess in the lower surface of the panel, and a track extending out of the guides for receiving a panel edge.

Installation of panel 100 atop bracket 10 is illustrated in FIGS. 4*a* and 4*b* and is more efficacious when notches 112*a*, 112*b*, 112*c*, and 112*d* are slightly larger than top members 32 and 42. The depth of notches 112*a*, 112*b*, 112*c*, and 112*d* accommodates the lateral wing recess from the top of the central bracket section 22. However, deeper notches may be used on thicker panels and shallower notches on thinner panels. To provide a continuous upper storage surface, it is preferred to use notches matching the height of the central bracket section 22 relative to the opposing top members 32, 42, respectively. With such arrangement, the upper surface of adjacent panels will be flush with the upper surface of the central bracket section 22 and thus remove likely tripping hazards.

Panel 100 may be in a number of sizes based on standard dimensions of spaced joists in a given country or region in that country. The wider the distance between joists typically dictates a thicker panel. An exemplary panel length is typically obtained from cutting a 4'×8' sheet in half to produce two 4'×4' panels but that too is not a fixed dimension. Standard lengths, widths, and thicknesses would be established for the various countries and applications. For example, in the U.S. a standard size panel to use above a standard 2×4 joist placed 16" OC would be 14'/2" wide and ½ inch to ¾ inch thick.

B. Method of Use of the Present Invention

In FIG. 4*a* joists J1 and J2 have four support brackets 10*a*, 10*b*, 10*c*, and 10*d* such as those in FIG. 1, spaced apart at approximately the same distance as notches 112*a*, 112*b*, 112*c*, and 112*d* of panel 100, such as that in FIG. 3. Panel 100 is then lowered atop the four support brackets and brackets 10*a*, 10*b*, 10*c*, and 10*d* are then moved back and forth along joists J1 and J2 until they rest securely in notches 112*a*, 112*b*, 112*c*, and 112*d* as illustrated in FIG. 4*b*.

Placement of storage goods may now be placed atop panel 100 up to a 250 lb per sq. ft. load or other storage capacity depending on the materials chosen for and size of the bracket and thickness of the panels.

In FIG. 4*c* panel 100 is securely in place as notches 112*a* and 112*b* rest atop side member 46 of bracket 10*a* and side member 36 of bracket 10*b* respectively. Along either side of the panel/bracket installation as illustrated, additional panels may be placed in the corresponding span between those outward joists (not shown).

C. Variations

Figure 5:
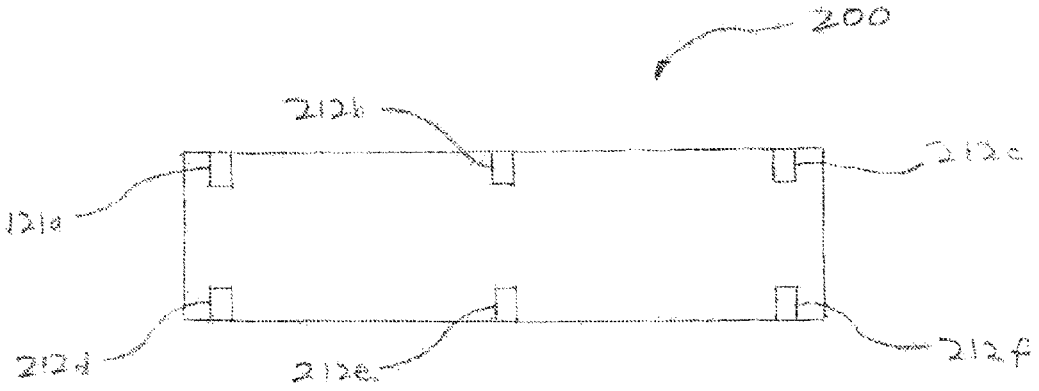
FIG. 5 is a bottom view of a floor panel of the present invention with six notches.

In addition to the many variations previously described, one obvious variation is a longer panel 200 as illustrated in FIG. 5. Panel 200 is essentially the same construction as panel 100 except that its longer length contains six notches: 212*a*, 212*b*, 212*c*, 212*d*, 212*e*, and 212*f*, instead of four. These six notches are specifically engineered to be placed at intervals that maximize structural integrity to meet the desired load requirements. It goes without saying that panels may contain any number of notches depending on length.

Figure 6:
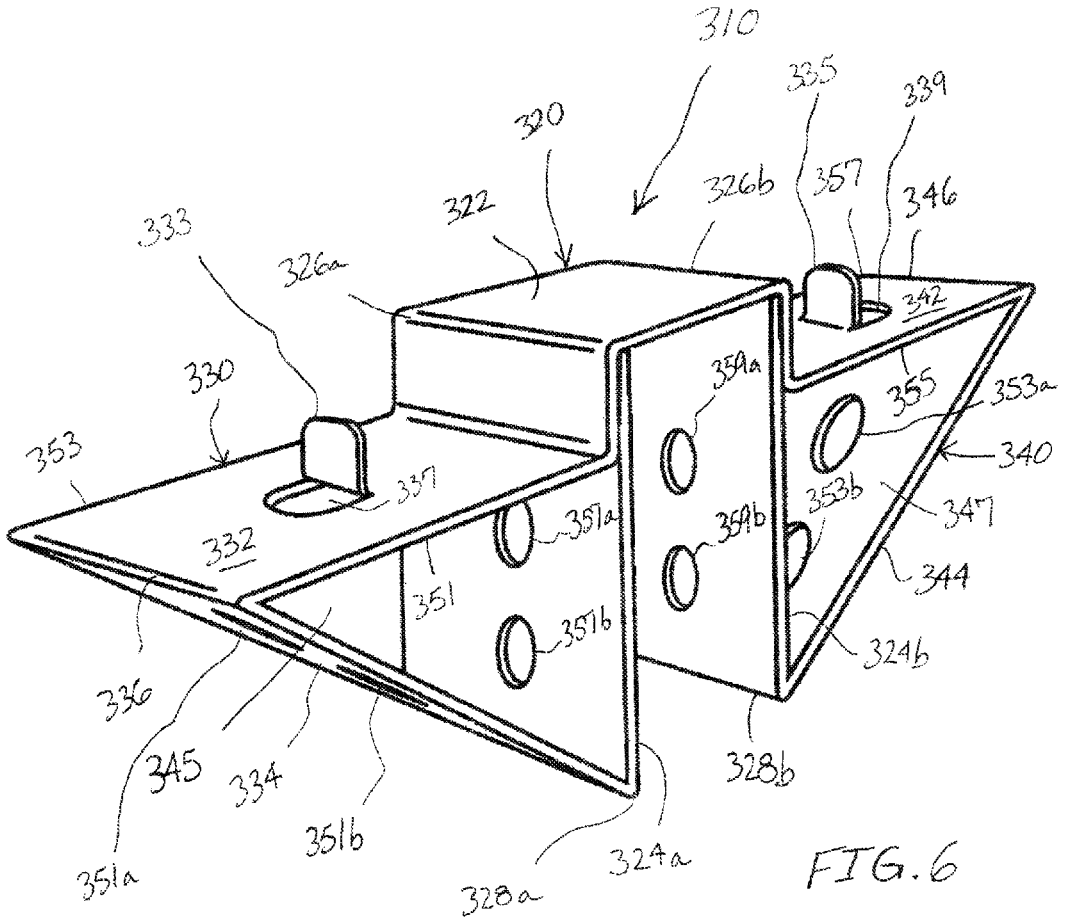
FIG. 6 is a perspective view of an alternative embodiment of a support bracket in accordance with the principles of the present invention.

Another variation of the support bracket may be found in FIG. 6 wherein like components are like numbered. In this exemplary embodiment, the support bracket, generally designated 310, generally includes all of the same features as with the support brackets 10, 50 with the following variations. Each wing 332, 342 includes an upwardly turned tab 333, 335, respectively, which is stamped or pressed out of the wing and bent upwardly to form an opening 337, 339, respectively. The tabs are generally rectangular in vertical profile with rounded upper corners and constructed to engage an opening, recess, or slot in a panel placed thereon. The tabs facilitate alignment of the panels with the underlying support brackets. In this exemplary embodiment, the uppermost extent of each tab does not protrude above the height of the center section 320. However, the uppermost extent of the tab may be flush with the upper surface of the center section or project beyond the upper surface of the center section.

Still referring to FIG. 6, the support bracket 330 also includes a set of fastener holes for a more secure assembly. In this exemplary embodiment, there are two fastener holes 351*a*, 351*b* projecting through the on the left brace 334, two fastener holes 353*a*, 353*b* projecting through the right brace 344, two fastener holes 357*a*, 357*b* on the left upright 324*a*, and two fastener holes 359*a*, 359*b* on the right upright 324*b*. The fasteners are generally vertically aligned on each section. They may also be offset from one another is desired to accommodate different fastener patterns.

In using the support bracket 330 of FIG. 6, a series of holes or slots may be introduced into a support panel. This may be facilitated for alignment purposes using a template. The support brackets 330 are then positioned atop opposing joists as with prior brackets 10, 50. The panel is then placed onto the exposed support brackets to align the upright tabs 333, 335 with a corresponding hole, slot, or recess in the panel and then lowered or snapped into placed with the bottom surface of the panel resting atop the underlying wing 332, 334. It will be appreciated that the tabs interlock with the corresponding holes to prevent significant slippage of the panel relative to the support bracket. A plurality of panels and support brackets may be used to provide a continuous or discrete support surface atop the joists. If desired, fasteners such as nails, screws, bolts, ties, straps, may be inserted through one or more fastener holes to secure a support bracket to an adjacent joist. The fasteners may be selected to provide a fixed or releasable connection.

The spirit of the present invention provides a breadth of scope that includes all methods of making and using. Any variation on the theme and methodology of accomplishing the same that are not described herein would be considered under the scope of the present invention. For example, the numbers for widths, thicknesses, lengths, recess depths, and other dimensional characteristics used herein are meant to be illustrative and not limiting.

Certain objects and advantages of the invention are described herein. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure.

It is also contemplated that various combinations or sub-combinations of the specific features and aspects of the embodiments may be made and still fall within the scope of the invention. Accordingly, it should be understood that various features and aspects of the disclosed embodiments may be combined with or substituted for one another in order to form varying modes of the disclosed invention. Thus, it is intended that the scope of the present invention herein disclosed should not be limited by the particular disclosed embodiments described above.

What is claimed is:

1. An attic flooring and storage system comprising:

a plurality of support brackets, each support bracket having:

a saddle body with a top plate with an upper surface and a lower surface;

a pair of opposing first and second guides projecting downwardly from the top plate, the first and second guides having spaced apart interior surfaces to cooperate with the top plate of the support bracket to form a central recess constructed to removably suspend the support bracket from a selected joist with the lower surface of the top plate resting against the upper surface of the selected joist and with the interior surfaces of the guides disposed adjacent to opposing sides of the selected joist;

a first support wing projecting laterally from an intermediate position along a length of the first guide;

a second support wing projecting laterally from the same intermediate position along a length of the second guide in an opposing direction to the first support wing;

a first angular brace projecting downwardly at an acute angle from the first support wing toward the first guide;

a second angular brace projecting downwardly at an acute angle from the second support wing toward the second guide; and at least one flooring panel having an upper planar surface and an opposing lower planar surface, the lower planar surface being interrupted by at least one recess for each support bracket used to support the flooring panel, each recess projecting partially through the panel from the lower planar surface and constructed to receive at least a portion of a support wing of a corresponding support bracket wherein two or more support brackets may be releasably suspended atop two opposing joists, the position of at least one support wings of each bracket may be adjusted relative to the corresponding recess in the flooring panel and the flooring panel set atop the support wings of at least two support brackets on the opposing joists with at least one support wing of each support bracket at least partially nested within a corresponding recess of the flooring panel to provide a support floor with the support wings of each bracket projecting laterally from the respective adjacent guides of the same bracket at a depth to match the thickness of the flooring panel to provide a flush continuous upper surface between the upper surface of the flooring panel and the top surface of the top plate of the corresponding support brackets.

2. The system of claim 1 wherein:

at least one angular brace of at least one support bracket projects downwardly and inwardly from an adjacent support wing of the least one support bracket at a forty-five degree angle to intersect the adjacent guide of the at least one support bracket to form a hollow space between the adjacent support wing, the adjacent guide, and the at least one angular brace.

3. The system of claim 1 wherein:

the entire support bracket is a single piece of metal formed by bending.

4. The system of claim 1 wherein:

at least one support wing is fixed to an adjacent guides.

5. The system of claim 1 wherein:

the angular braces of at least one support bracket are fixed to the corresponding adjacent support wings and the corresponding adjacent guides of the least one support bracket.

6. The system of claim 1 wherein:

for each support bracket, the corresponding support wings project outwardly from the corresponding adjacent guides at a right angle.

7. The system of claim 1 wherein:

for each support bracket, the corresponding guides project downwardly from the corresponding top plate at a right angle.

8. The system of claim 1 wherein:

a set of four support brackets is used for each flooring panel with a corresponding number of recesses.

9. The system of claim 1 wherein:

a set of six support brackets is used for each flooring panel with a corresponding number of recesses.

10. The system of claim 1 wherein:

at least one support wing of at least one support bracket includes an alignment element constructed to align the at least one support wing with a flooring panel placed atop the at least one support wing.

11. The system of claim 1 wherein:

at least one angular brace of at least one support bracket is constructed to transmit bending forces about a joint between a corresponding adjacent support wing and a corresponding adjacent guide to a side of the joist when mounted thereon.

12. A method of installing an attic flooring and storage system comprising:

providing a plurality of support brackets, each having:

a saddle body with a top plate having an upper surface and a lower surface, a pair of opposing guides projecting downwardly from the top plate, the guides having opposing spaced apart interior surfaces constructed to cooperate with the lower surface of the top plate to form a central recess and slidably hang along a section of a joist wherein the lower surface of the top plate rests against the upper surface of the joist with the interior surfaces of the guides to either side of the joist, a first support wing projecting laterally from an intermediate position along a length of the first guide, a second support wing projecting laterally from the same intermediate position along a length of the second guide in an opposing direction to the first support wing, a first angular brace projecting downwardly at an acute angle from the first support wing to intersect the first guide, and a second angular brace projecting downwardly at an acute angle from the second support wing to intersect the second guide;

providing at least one flooring panel having an upper planar surface and an opposing lower planar surface, the lower planar surface being interrupted by at least one recess for each support bracket, the recess projecting partially through the lower planar surface of the flooring panel and constructed to receive a support wing of a support bracket;

releasably installing a plurality of support brackets atop two opposing joists;

adjusting the position of the wings of each bracket on the opposing joints relative to the spacing of the recesses in the flooring panel; and setting the flooring panel atop the support wings with each support wing at least partially nested within a corresponding recess of the flooring panel to provide a support structure wherein the upper surface of the installed flooring panel is flush with the upper surface of the top plate.

13. The method of claim 12 further comprising:

placing a plurality of panels in an adjacent arrangement with one or more brackets selected from the plurality of support brackets therebetween to provide a continuous support structure.

14. The method of claim 12 wherein:

at least one support bracket selected from the plurality of support brackets is provided with a corresponding angular brace that is fixed to the adjacent support wing and the adjacent guide of the at least one support bracket.

15. The method of claim 12 wherein:

at least one angular brace of at least one support bracket selected from the plurality of support brackets is constructed to transmit bending forces about a joint on the at least one support bracket between a corresponding support wing and an adjacent guide to the side of the joist when mounted thereon.

* * * * *